US007932222B2

(12) United States Patent
Guo et al.

(10) Patent No.: US 7,932,222 B2
(45) **Date of Patent: *Apr. 26, 2011**

(54) TRIGGERED RESPONSE COMPOSITIONS

(75) Inventors: Hailan Guo, Warrington, PA (US); Ching-Jen Chang, Ambler, PA (US)

(73) Assignee: Rohm and Haas Company, Philadelphia, PA (US)

( * ) Notice: Subject to any disclaimer, the term of this patent is extended or adjusted under 35 U.S.C. 154(b) by 847 days.

This patent is subject to a terminal disclaimer.

(21) Appl. No.: 10/348,375

(22) Filed: Jan. 21, 2003

(65) Prior Publication Data

US 2003/0164476 A1 Sep. 4, 2003

Related U.S. Application Data

(60) Provisional application No. 60/351,581, filed on Jan. 25, 2002.

(51) Int. Cl.
*C11D 3/37* (2006.01)
*C11D 17/00* (2006.01)

(52) U.S. Cl. ..... 510/438; 510/349; 510/361; 510/441; 510/476; 510/477

(58) Field of Classification Search ..... 510/349, 510/361, 438, 441, 476, 477
See application file for complete search history.

(56) References Cited

U.S. PATENT DOCUMENTS

| | | | | |
|---|---|---|---|---|
| 4,384,096 | A * | 5/1983 | Sonnabend | 526/313 |
| 6,063,857 | A * | 5/2000 | Greenblatt et al. | 524/561 |
| 6,727,216 | B1 | 4/2004 | Waeschenbach | |
| 2001/0031714 | A1 * | 10/2001 | Gassenmeier et al. | 510/276 |
| 2003/0164476 | A1 * | 9/2003 | Guo et al. | 252/384 |
| 2004/0018952 | A1 * | 1/2004 | Gray et al. | 510/476 |
| 2004/0030034 | A1 * | 2/2004 | Chang et al. | 524/543 |
| 2004/0110891 | A1 * | 6/2004 | Guo et al. | 524/522 |

FOREIGN PATENT DOCUMENTS

| | | |
|---|---|---|
| EP | 1284283 A1 | 2/2003 |
| JP | 7096166 A | 4/1995 |
| WO | WO 00/17311 | 3/2000 |
| WO | WO 01/44435 A1 | 6/2001 |

* cited by examiner

*Primary Examiner* — Brian P Mruk
(74) *Attorney, Agent, or Firm* — Carl P. Hemenway

(57) ABSTRACT

This invention provides a triggered response composition in the form of a barrier material and a delivery device that includes one or more polyelectrolytes in contact with an aqueous system that is stable and insoluble in an aqueous system and that exhibits one or more chemical/physical responses in the aqueous system, wherein the chemical/physical response of the composition is triggered upon one or more changes in ionic strength of the aqueous system.

1 Claim, No Drawings

TRIGGERED RESPONSE COMPOSITIONS

CROSS REFERENCE TO RELATED PATENT APPLICATIONS

This is a non-provisional application of prior pending U.S. provisional application Ser. No. 60/351,581 filed Jan. 25, 2002.

The present invention relates to compositions that are capable of producing a chemical or physical response that is triggered upon exposing the compositions to an aqueous system containing one or more or a series of triggering events, each triggering event encompassing a chemical/physical process or property. In particular, it relates to regulating the stability of polyelectrolyte compositions in an aqueous system by triggering events in the aqueous system that result in the dissolution, degradation, swelling or dispersion of the polyelectrolyte compositions at a specified time, the triggering events brought about by marked alterations in ionic strength and those in addition to ionic strength including: dilution, temperature, mechanical forces and combinations thereof. The present invention is further directed to devices containing triggered responsive compositions useful for the delivery of active ingredients and beneficial agents in an aqueous system to an environment of use.

It is often desirable to provide compositions and devices that deliver or provide controlled release of one or more active ingredients/beneficial agents to an environment of use. Especially in fabric care applications, detergent compositions containing various types of active ingredients in addition to detergents are sought to improve the effectiveness of cleaning during washing and the delivery of such additional actives during post washing processes, namely rinsing, spinning and drying.

International Publication Patent No. WO 00/17311 discloses a coated a detergent active encapsulated with a coating material which enabling a delayed release of the detergent active in to a washing solution, the coating material being insoluble in a washing solution having a pH equal to or greater than 10 at 25° C., yet being soluble in a washing solution having a pH equal to or less than 9 at 25° C. The coating materials disclosed include amines, waxes, Schiff base compounds and mixtures thereof. U.S. Patent Application Publication No. 2001/0031714 A1 discloses a laundry detergent portion having two or more detersive components of which at least two are released into the wash liquor at different times, the portion including at least one temperature or pH switch to provide controlled release of the detersive components. The switch materials disclosed include waxes, aminoalkyl methacrylate copolymers and polyvinyl pyridine polymers.

Encapsulated active ingredients having a pH sensitive coating material to delay release of the actives, however, suffer a number of limitations, especially for fabric laundry applications. The use of pH sensitive materials alone to achieve triggered release of detergent actives to rinse cycle is difficult because of the problem of the active or beneficial agent prematurely leaking into the wash liquor during the washing cycle. As a consequence, all the detergent actives disperse in the washing liquor and are subsequently removed when the wash liquor drains between cycles, preventing the controlled release of the desired actives in post washing processes or the desired actives are released in amounts that are not effective in achieving the beneficial effect of the active as a result of controlled release. In addition, it is difficult to precisely control the release of active ingredients in a complex system such as a fabric laundry system including a broad spectrum of soil containing loads, numerous ingredients, varying water purity, varying amounts of water hardness, varying wash conditions, varying detergent concentration, a broad spectrum of washing machine designs, cycle lengths, washing and rinsing temperatures practiced by users worldwide. Despite attempts disclosed in the prior art to control the delivery of detergent active ingredients, numerous limitations associated with the controlled release materials has left many problems related to the controlled release of active ingredients and beneficial agents of utility in industrial applications, household products, and personal care largely unsolved. Inventors have discovered that polyelectrolyte compositions including one or more trigger means in addition to ionic strength have significant utility as triggered release barrier materials, encapsulating agents and devices for the triggered delivery of fabric care active ingredients and other related beneficial agents in an environment of use.

One practical solution to the problem of controlled release was to use polyelectrolyte compositions whose polymer properties such as stability and solubility were a function of changes in one or more chemical and/or physical properties of the aqueous system in which the polyelectrolyte was dispersed. Adjusting one or more chemical and/or physical properties of the aqueous system, such as the ionic strength, trigger the polyelectrolyte to respond by destabilizing, dissolving, swelling or dispersing in to the aqueous system under relatively low ionic strength conditions while remaining stable and insoluble in an altered or separate aqueous system under relatively high ionic strength conditions. Active ingredients and beneficial agents contained therein or encapsulated by barriers and devices constructed from such polyelectrolyte compositions are retained in order to protect such actives and agents in an aqueous system such as a fabric laundry wash cycle and which then can be triggered or manipulated to produce a desired release of actives via dissolution, degradation, swelling or dispersion of the polyelectrolyte barriers during a subsequent process, such as fabric laundry rinse cycle, the chemical/physical polymer response triggered through alterations of one or more or a series of chemical and/or physical properties of the aqueous system and one or more chemical and physical properties in addition to ionic strength including: pH, temperature, mechanical agitation and combinations of thereof.

The present inventors have discovered that alkali soluble/swellable emulsion (ASE) polymers and preferably, hydrophobically modified alkali soluble/swellable emulsion (HASE) polymers incorporating carefully selected monomer compositions and meticulously designed polymeric structures such that the triggered response characteristics of the polymers is a function of changes in one or more chemical and physical properties of both the polyelectrolyte and the aqueous system in which they are in contact with (e.g. dispersed in) as a consequence of one or more parameters including the type and amounts of acidic monomers, the degree of neutralization of the acidic monomers, the type and amounts of non-ionic vinyl surfactants, the ionic strength of the aqueous system, the pH of the aqueous system, rates of polymer hydration, diffusion of water and ions within the polymer, polymer thermodynamic stability, polymer swelling rates and kinetics, and mechanical stability of the polymer in the form of aggregated particles, co-granulated particles and films. Inventors have further discovered that such polyelectrolytes form effective barrier materials for surrounding, encapsulating and/or forming a matrix with one or more active ingredients in an aqueous system and that the stability of the barrier materials can be usefully manipulated to respond to changes in one or more chemical and/or physical properties of the aqueous system in addition to ionic strength including: pH, temperature, mechanical agitation, dilution and combinations thereof. In an aqueous system such as fabric washing cycle under relatively high ionic strength conditions, the polymer compositions are sufficiently stable and form effective barriers to contain or encapsulate one or more active ingredients/beneficial agents. Exposing the compositions to an aqueous system under relatively low ionic strength conditions, such as fabric rinsing cycle, triggers instability in the compositions such that the active ingredients are rapidly dispersed in the aqueous system. The triggered response compositions of the present invention obviate the limitations to the prior art noted above and provide new compositions, devices, and processes for delivering controlled release of one or more active ingredients/beneficial agents to an environment of use.

Accordingly, there is provided a triggered response composition comprising: one or more polyelectrolytes in contact with an aqueous system that is stable and insoluble in an aqueous system at relatively high ionic strength and that exhibits one or more chemical/physical responses selected from dispersing, degrading, dissolving, destabilizing, deforming, swelling, softening, melting, flowing and combinations thereof; wherein the chemical/physical response of the composition is triggered upon one or more ionic strength changes to the aqueous system. The polyelectrolyte is one or more alkali soluble emulsion polymers comprising: (a) 15-70 weight percent of one or more acidic monomers; (b) 15-80 weight percent of one or more non-ionic vinyl monomers; (c) 2-30 weight percent of one or more non-ionic vinyl surfactant monomers; and (d) 0-5 weight percent of one or more polyethylenically unsaturated monomers, wherein the chemical/physical response of the polymers as a function of ionic strength changes is dependent on one or more parameters selected from the group consisting of (i) the type and amounts of acidic monomers, (ii) the degree of neutralization of the acidic monomers, (iii) the type and amounts of non-ionic monomers, (iv) the type and amounts of non-ionic vinyl surfactant monomers, (v) the type and amounts of polyethylenically unsaturated monomers, (vi) the pH of the aqueous system and (vii) combinations thereof. The composition is stable and insoluble in an aqueous system at relatively high ionic strength and the composition disperses, dissolves, deforms, swells or degrades in an aqueous system at relatively low ionic strength or when the ionic strength of the aqueous system in contact with the composition is lowered. The aqueous system is a fabric washing or cleaning system and wherein the chemical/physical response of the polymers is a function of changes in one or more parameters in addition to ionic strength selected from: pH, surfactant concentration level, temperature, mechanical agitation and the combinations thereof. The polyelectrolyte described above is a HASE polymer and is an ASE polymer when a vinyl non-ionic surfactant is absent. The preferred ASE polymers usefully employed in the present invention are HASE polymers. In a preferred embodiment, the HASE polymer comprises: (a) 20-50 weight percent of one or more acidic monomers; (b) 20-70 weight percent of one or more non-ionic vinyl monomers; (c) 2-20 weight percent of one or more non-ionic vinyl surfactant monomers; and (d) 0.05 to 0.5 weight percent of one or more polyethylenically unsaturated monomers Secondly, there is provided a triggered response barrier composition comprising: one or more polyelectrolytes in contact with an aqueous system, wherein the barrier composition surrounds, encapsulates or forms a matrix with one or more active ingredients; wherein the barrier composition is stable and insoluble in an aqueous system at relatively high ionic strength; wherein the barrier exhibits one or more chemical/physical responses selected from dispersing, degrading, dissolving, destabilizing, deforming, swelling, softening, flowing and combinations thereof; wherein the chemical/physical response of the composition is triggered upon one or more ionic strength changes to the aqueous system; and wherein the barrier composition is capable of releasing the active ingredients to the aqueous system as a result of the triggered response.

There is provided a device for the triggered release of one or more active ingredients to an aqueous system comprising:

(a) one or more active ingredients;

(b) one or more additives; and (c) a barrier composition comprising one or more ionic strength responsive polyelectrolytes;

wherein the barrier composition surrounds, encapsulates or forms a matrix with one or more active ingredients; wherein the barrier composition is stable and insoluble in an aqueous system at relatively high ionic strength; wherein the barrier exhibits one or more chemical/physical responses selected from dispersing, degrading, dissolving, destabilizing, deforming, swelling, softening, flowing and combinations thereof, wherein the chemical/physical response of the composition is triggered upon one or more ionic strength changes to the aqueous system; and wherein the device is capable of releasing the active ingredients to the aqueous system as a result of the triggered response of the barrier composition.

There is also provided a process for triggering the release of one or more active ingredients to an aqueous system comprising the steps of:

(a) surrounding, encapsulating or forming a matrix with one or more active ingredients with an ionic strength responsive barrier composition, the barrier being substantially impermeable to releasing the active ingredients to the aqueous system and remaining insoluble in the aqueous system; and (b) altering the ionic strength of the aqueous system;

wherein the barrier composition disperses, destabilizes, disintegrates, dissolves, deforms or swells and becomes substantially permeable, thereby triggering the release of the active ingredients into the aqueous system.

The term "polyelectrolyte" as it relates to the present invention refers to a polymer or macromolecular compound in contact with an aqueous system containing a plurality of ionized and/or ionizable groups within the polymer as a result of the polymerization of one or more monomers having ionized and/or ionizable groups. The polyelectrolyte is in contact with an aqueous system including for example water, water incorporating hydrogen bonding solvents, polar solvents and organic solvents. It is contemplated that non-aqueous systems, including for example those containing solvents that can solvate ions and charged groups, are usefully employed in the present invention. Polyelectrolytes usefully employed in the invention may contain exclusively cationic groups, may contain exclusively anionic groups or may be amphoteric, containing a combination of cationic and anionic groups. The individual ionizable components of the polyelectrolyte include weak or strong acidic groups, such as for example sulphonic, phosphonic and carboxylic groups respectively; weak or strong basic groups such as for example primary amines, secondary amines, amides, phosphines and tertiary amines respectively; and amphoteric groups such as amino acids for example. The acidic groups of the polyelectrolytes are un-neutralized, partially neutralized or completely neutralized. The basic groups of the polyelectrolytes are un-neutralized and/or un-quaternized, partially neutralized and/or quaternized or completely neutralized and/or quaternized.

Suitable examples of polyelectrolytes usefully employed in the invention include poly(acidic) homopolymers, copolymers and salts thereof such as polycarboxylic acid polymers and salts thereof, alkali soluble emulsion polymers, hydrophobically modified alkali soluble emulsion polymers and polyaspartic polymers; poly(basic) homopolymers, copolymers and salts thereof, and amphoteric homopolymers, copolymers and salts thereof. Preferred polyelectrolytes include alkali soluble emulsion polymers, referred to as ASE polymers and hydrophobically modified alkali soluble emulsion polymers, referred to as HASE polymers, and polyaspartic acid polymers.

The term "triggered response" as it relates to the present invention refers to regulating, manipulating or altering one or more chemical/physical properties of a polymer composition in contact with an aqueous system by triggering changes in or through alteration of one or more chemical/physical parameters or properties of the aqueous system. Typical polymer chemical/physical parameters of interest include for example solubility, swelling behavior, stability, porosity, degree of neutralization, polymer colligative properties, acid/base properties of polymer functional groups, and reactivity of polymer functional groups. Typical chemical/physical parameters and properties of the aqueous system in addition to ionic strength include, for example, pH, temperature, surfactant concentration, mechanical forces such as pressure, osmotic pressure, diffusion, mechanical agitation, chemical reagents capable of reacting with or neutralizing polymer functional groups, colligative properties of the aqueous system and combinations of such parameters. The inventors have discovered that the solubility, dispersibility, deformability, swellability and stability response of alkali soluble/swellable emulsion (ASE and HASE) polymers in an aqueous system can be triggered by altering or changing the ionic strength of the aqueous system; and in addition to the ionic strength, changes in pH, surfactant concentration, temperature, mechanical forces and combinations thereof.

Alkali soluble/swellable emulsion (ASE) polymers are polyelectrolytes based on acid-containing emulsion polymers disclosed in U.S. Pat. Nos. 3,035,004 and 4,384,096 (HASE polymers) and Great Britain Pat. No. 870,994. The inventors have discovered that adjusting the type and level of acid monomers and co-monomers in ASE polymers coupled with the degree of neutralization to achieve optimum charge density to afford polymers that are stable, having a low degree of swelling and insoluble in an aqueous system of relatively high ionic strength. The polymers usefully employed in the invention have varying degree of neutralization of the carboxylic acid groups ranging from partially to completely neutralized. The polymers can be characterized as incorporating an ionic strength trigger or referred to as ionic strength sensitive polymers. Changes in the ionic strength of the aqueous system to lower levels results in the a polymer that rapidly disperses, dissolves or swells to a significant extent in the aqueous system.

The ASE and HASE polymers of the present invention are typically prepared using standard emulsion polymerization techniques under acidic conditions such that the carboxylic acid groups are in protonated form to insolubilize the polymer and afford a liquid emulsion. When added as a liquid colloidal dispersion, the finely divided ASE polymer particles dissolve almost instantly upon pH adjustment. The degree of neutralization, the type and amounts of both acidic monomers and non-ionic surfactant groups of the HASE polymers can be controlled precisely, affording ionic strength sensitive polymers whose stability, dispersibility, swell properties and solubility depend on the ionic strength of the aqueous system. The polymer compositions usefully employed in the present invention incorporate one or more trigger means, namely an ionic strength triggering condition. The ease of handling, metering, and dispersing ASE and HASE polymers, the rapid solubilization and optimization of charge density on neutralized acidic functional groups by controlled pH adjustment, and the highly desirable film forming and barrier properties make ASE and HASE polymers a most effective and efficient barrier composition for a wide variety of applications including regulated release devices for personal care and household actives, encapsulating compositions that effect the controlled release of beneficial agents and active ingredients, sensor materials and sensing devices, imaging and diagnostic agents, materials and devices for separations, molecular recognition, tracing and biological molecular conjugate assays.

Required Monomer Components of ASE and HASE Polymers

The HASE polymers of this invention require three essential components, as disclosed in U.S. Pat. No. 4,384,096: (a) 15-70 weight percent of one or more acidic monomers, (b) 15-80 weight percent of one or more non-ionic vinyl monomers, (c) 2-30 weight percent of one or more non-ionic vinyl surfactant monomers, and optionally (d) 0.01-5 weight percent of one or more polyethylenically unsaturated monomers. It has been discovered that the effectiveness of ASE and HASE polymers as ionic strength responsive compositions for triggered release is critically dependent on the following components: (i) the type and amounts of acidic monomers, (ii) the degree of neutralization of the acidic monomers, and (iii) the type and amounts of non-ionic vinyl monomers, (iv) the type and amounts of non-ionic vinyl surfactant monomers, (v) the type and amounts of polyethylenically unsaturated monomers, (vi) the pH of the aqueous system and (vii) combinations thereof.

The acid monomers provide the requisite ionic strength responsiveness and the degree of neutralization of the acidic monomers is critical in optimizing the charge density of the acidic groups. The non-ionic vinyl monomers provide an extended polymer backbone structure and added hydrophobic balance. The non-ionic vinyl surfactant monomers provide a bound surfactant. All four components contribute to preparing ionic strength sensitive polymers and barrier compositions whose stability, swell properties and solubility depend on the ionic strength of the aqueous system. Within the stated limits, the proportions of the individual monomers can be varied to achieve optimum properties for specific triggered release applications.

Acidic Monomers

The ASE and HASE polymers require 15-70 weight percent based on total monomer content of one or more acidic monomers selected from the group consisting of $C_3$-$C_8$ $\alpha,\beta$-ethylenically unsaturated carboxylic acid monomers such as acrylic acid, methacrylic acid, maleic acid, crotonic acid, itaconic acid, fumaric acid, aconitic acid vinyl sulfonic acids and vinyl phosphonic acids, acryloxypropionic acid, methacryloxypropionic acid, monomethyl maleate, monomethyl fumarate, monomethyl itaconate and the like and combinations thereof. Acrylic acid (AA) or methacrylic acid (MAA) or a mixture thereof are preferred. Mixtures of AA or MAA with itaconic or fumaric acid are suitable and mixtures of crotonic and aconitic acid and half esters of these and other polycarboxylic acids such as maleic acid with $C_1$-$C_4$ alkanols are also suitable, particularly if used in minor amount in combination with acrylic or methacrylic acid. For most purposes, it is preferable to have at least about 15 weight percent and most preferably from about 20-50 weight percent of acidic monomers. However, polycarboxylic acid monomers and half esters can be substituted for a portion of the acrylic or methacrylic acid, e.g., about 1-15 weight percent based on total monomer content.

Non-Ionic Vinyl Monomers

To provide a stable aqueous dispersion and a desirable hydrophobic:hydrophilic balance needed for the ASE and HASE polymers of the present invention requires about 15-80 weight percent of one or more co-polymerizable non-ionic monomers selected from the group consisting of $C_2$-$C_{18}$ α,β-ethylenically unsaturated monomers, $C_1$-$C_8$ alkyl and $C_2$-$C_8$ hydroxy alkyl esters of acrylic and methacrylic acid including ethyl acrylate, ethyl methacrylate, methyl methacrylate, 2-ethylhexyl acrylate, butyl acrylate, butyl methacrylate, 2-hydroxyethyl acrylate, 2-hydroxybutyl methacrylate; styrene, vinyltoluene, t-butylstyrene, isopropylstyrene, and p-chlorostyrene; vinyl acetate, vinyl butyrate, vinyl caprolate; acrylonitrile, methacrylonitrile, butadiene, isoprene, vinyl chloride, vinylidene chloride, and the like. In practice, a mono vinyl ester such as methyl acrylate, ethyl acrylate, butyl acrylate is preferred.

These monomers, of course, must be co-polymerizable with the acidic monomers and vinyl surfactant monomers. Normally about 15-80 weight percent, and preferably about 20-70 weight percent of nonionic vinyl monomer, based on total weight of monomers, is used in preparing ASE polymers.

Non-Ionic Vinyl Surfactant Monomers of HASE Polymers

The third required monomer is about 0.1-30 weight percent based on total monomer content of one or more non-ionic vinyl surfactant monomers, preferably selected from the group consisting of an acrylic or methacrylic acid ester of a $C_{12}$-$C_{24}$ alkyl monoether of a polyalkylene glycol having at least 2 oxyalkylene units therein, preferably having at least 6 to 70 oxyalkylene units. More preferred are the acrylate and methacrylate surfactant esters selected from the group consisting of: alkyl phenoxy poly(ethyleneoxy)ethyl acrylates and methacrylates; alkoxy poly(ethyleneoxy)ethyl acrylates and methacrylates; wherein ethyleneoxy unit is about 6-70. Preferable monomers may be defined by the general formula $H_2C{=}C(R)—C(O)—O(CH_2CH_2O)_nR'$ wherein R is H or $CH_3$, the latter being preferred, n is at least 2, and preferably has an average value of at least 6, up to 40 to 60 and even up to 70 to 100 and R' is a hydrophobic group, for example, an alkyl group or an alkyl phenyl group having 12 to 24 carbon atoms or having an average of 12 to 24 or more carbon atoms. It is preferable to have at least about 2 weight percent and most preferably from about 2-20 weight percent of non-ionic vinyl surfactant monomers.

These essential vinyl surfactant monomers are the acrylic or methacrylic acid esters of certain nonionic surfactant alcohols. Such surfactant esters are known in the art. For example, Junas et al. U.S. Pat. No. 3,652,497 describe the use of alkylphenoxypoly(ethyleneoxy)ethyl acrylates in preparing several other polymeric surfactant thickeners. Dickstein U.S. Pat. No. 4,075,411 describes several processes for preparing such vinyl surfactant esters including the acid catalyzed condensation of commercially available nonionic polyoxyalkylene surfactant alcohols such as alkylphenoxypoly(ethyleneoxy)ethyl alcohol and block-polymeric glycols with acrylic, methacrylic, crotonic, maleic, fumaric, itaconic or aconitic acid. Alternate esterification methods including alcoholysis and transesterification are also described. Other suitable vinyl surfactant esters can be prepared from monoethers of mixed or heteropolymeric ethyleneoxypropyleneoxy-butyleneoxy polyglycols such as described in Patton U.S. Pat. No. 2,786,080. Additional surfactant alcohols which can be esterified for use herein are given in "McCutcheon's Detergents and Emulsifiers" 1973, North American Edition, Allured Publishing Corp., Ridgewood, N.J. 07450.

Certain of these vinyl surfactant monomer esters, i.e., those defined by the Formula are useful in preparing the HASE polymers described herein. It is essential that the surfactant be incorporated in the liquid emulsion product by copolymerization. Advantageously the requisite surfactant esters are prepared by the direct acid catalyzed esterification of the appropriate surfactant alcohol with an excess of the carboxylic acid monomer used as Component A. The resulting mixture with excess acid can be used directly in the copolymerization provided that at least 30 percent, and preferably 50-70 percent or more, of the surfactant alcohol in the mixture is esterified. The vinyl surfactant ester can also be recovered, purified by conventional means using an appropriate inhibitor such as hydroquinone or p-tert-butylcatechol to prevent undesired homopolymerization, and then used to prepare HASE polymers.

It has been found that the balance of acidic monomers to non-ionic monomers is an important factor in the triggered release response and performance of the resulting ASE and HASE polymers used in barrier or encapsulating compositions and delivery devices.

Optionally, the ASE and HASE polymers include a small amount of at least one polyethylenically unsaturated monomer, to provide a polymer having a network structure. One or more polyethylenically unsaturated monomers may be combined with the monomers during the polymerization process or may be added after the polymerization of monomers. Suitable examples include allyl methacrylate (ALMA), ethylene glycol dimethacrylate (EGDMA), butylene glycol dimethacrylate (BGDMA), diallyl phthalate (DAP), methylenebisacrylamide, pentaerythritol di-, tri- and tetra-acrylates, divinyl benzene, polyethylene glycol diacrylates, bisphenol A diacrylates and combinations thereof. Low levels of the polyethylenically unsaturated monomers are preferred, since levels greater than about 5% by weight tend to over cross-link the polymer or provide a polymer network structure such that their effectiveness in the invention markedly decreases. Preferred amounts of the polyethylenically unsaturated monomers range from 0.01 to 5% by weight based on the total weight of the polymer, more preferably from 0.05 to 0.5% by weight based on the total weight of the polymer.

Polymerization Conditions

The ASE and HASE polymers are conveniently prepared from the above-described monomers by conventional emulsion polymerization at an acid pH lower than about 5.0 using free-radical producing initiators, usually in an amount from 0.01 percent to 3 percent based on the weight of the monomers. The free-radical producing initiators conveniently are peroxygen compounds especially inorganic persulfate compounds such as ammonium persulfate, potassium persulfate, sodium persulfate; peroxides such as hydrogen peroxide; organic hydroperoxides, for example, cumene hydroperoxide, t-butyl hydroperoxide; organic peroxides, for example, benzoyl peroxide, acetyl peroxide, lauroyl peroxide, peracetic acid, and perbenzoic acid (sometimes activated by a water-soluble reducing agent such as ferrous compound or sodium bisulfite); as well as other free-radical producing materials such as 2,2'-azobisisobutyronitrile.

The process for preparing ASE polymers of this invention includes a free radical thermal initiator or redox initiator system under emulsion polymerization conditions. Monomers suitable for the novel process include hydrophobic and hydrophilic monoethylenically unsaturated monomers which can be subjected to free radical polymerization in a straight forward manner. "Hydrophilic" refers to monoethylenically unsaturated monomers which have high water solubility under the conditions of emulsion polymerization, as described in U.S. Pat. No. 4,880,842. "Hydrophobic" refers to monoethylenically unsaturated monomers which have low water solubility under the conditions of emulsion polymerization, as described in U.S. Pat. No. 5,521,266.

Suitable thermal initiators include, for example, hydrogen peroxide, peroxy acid salts, peroxodisulfuric acid and its salts, peroxy ester salts, ammonium and alkali metal peroxide salts, perborate salts and persulfate salts, dibenzoyl peroxide, t-butyl peroxide, lauryl peroxide, 2,2'-azo bis(isobutyronitrile) (AIBN), alkyl hydroperoxides such as tert-butyl hydroperoxide, tert-amyl hydroperoxide, pinene hydroperoxide and cumyl hydroperoxide, t-butyl peroxyneodecanoate, t-butyl Peroxypivalate and combinations thereof.

Suitable oxidants of the redox initiator system include water-soluble oxidizing compounds such as, for example, hydrogen peroxide, peroxy acid salts, peroxodisulfuric acid and its salts, peroxy ester salts, ammonium and alkali metal peroxide salts, perborate salts and persulfate salts. Suitable oxidants of a redox initiator system also include water-insoluble oxidizing compounds such as, for example, dibenzoyl peroxide, t-butyl peroxide, lauryl peroxide, 2,2'-azo bis (isobutyronitrile) (AIBN), alkyl hydroperoxides such as tert-butyl hydroperoxide, tert-amyl hydroperoxide, pinene hydroperoxide and cumyl hydroperoxide, t-butyl peroxyneodecanoate, and t-butyl peroxypivalate. Compounds which donate oxygen with free radical formation and are not peroxides, such as alkali metal chlorates and perchlorates, transition metal oxide compounds such as potassium permanganate, managanese dioxide and lead oxide and organic compounds such as iodobenzene, may be usefully employed in accordance with the invention as oxidants. The term "water-insoluble" oxidants means oxidizing compounds having a water solubility of less than 20% by weight in water at 25° C. Peroxides, hydroperoxides and mixtures thereof are preferred and tert-butyl hydroperoxide is most preferred. Typical levels of oxidant range from 0.01% to 3.0%, preferably from 0.02% to 1.0% and more preferably from 0.05% to 0.5% by weight, based on the weight of the monomer used.

Suitable reductants of the redox initiator system include reducing compounds such as, for example, sulfur compounds with a low oxidation state such as sulfites, hydrogen sulfites, alkali metal bisulfites, ketone adducts of bisulfites such as acetone bisulfite, alkali metal disulfites, metabisulfites and its salts, thiosulfates, formaldehyde sulfoxylates and its salts, reducing nitrogen compounds such as hydroxylamine, hydroxylamine hydrosulfate and hydroxylammonium salts, polyamines and reducing sugars such as sorbose, fructose, glucose, lactose and derivatives thereof, enediols such as ascorbic acid and isoascorbic acid, sulfinic acids, hydroxy alkyl sulfinic acids such as hydroxy methyl sulfinic acid and 2-hydroxy-2-sulfinacetic acid and its salts, formadinesulfinic acid and its salts, alkyl sulfinic acids such propyl sulfinic acid and isopropyl sulfinic acid, aryl sulfinic acids such as phenyl sulfinic acid. The term "salts" includes for example sodium, potassium, ammonium and zinc ions. Sodium formaldehyde sulfoxylate, also known as SSF, is preferred. Typical levels of reductant range from 0.01% to 3.0%, preferably from 0.01% to 0.5% and more preferably from 0.025% to 0.25% by weight, based on the weight of the monomer used.

The metal promoter complex of the redox initiator system includes a water-soluble catalytic metal compound in the form of a salt and a chelating ligand. Suitable metal compounds include metal salts such as, for example iron(II, III) salts such as iron sulfate, iron nitrate, iron acetate and iron chloride, cobalt(II) salts, copper(I, II) salts, chromium (II) salts, manganese salts, nickel(II) salts, vanadium salts such as vanadium(III) chloride, vanadium(IV) sulfate and vanadium (V) chloride, molybdenum salts, rhodium salts and cerium (IV) salts. It is preferred that metal compounds are in the form of hydrated metal salts. Typical levels of catalytic metal salts used in accordance with the invention range from 0.01 ppm to 25 ppm. Mixtures of two or more catalytic metal salts may also be usefully employed in accordance with the invention.

Metal complexes that promote the redox cycle in a redox initiator system must not only be soluble, but must have suitable oxidation and reduction potentials. Generally stated, the oxidant must be able to oxidize the low oxidation state of metal promoter complex (e.g. Fe(II)->Fe(III)) and conversely, the reductant must be able to reduce the high oxidation state of the metal promoter catalyst (e.g. Fe(III)->Fe(II)). The choice of a particular oxidant and reductant usefully employed in a redox initiator system for preparing aqueous emulsion polymers from two or more ethylenically unsaturated monomers depends on the redox potentials of the metal salts. In addition, the ratio of oxidant to reductant ranges from 0.1:1.0 to 1.0:0.1, depending on the redox potential of the metal salt employed. For the efficient reduction of monomer levels in an aqueous polymer dispersion prepared from one or more ethylenically unsaturated monomers, it is preferred that the chelating ligand used in combination with the soluble metal salt is a multidentate aminocarboxylate ligand having fewer than six groups available for coordination to the metal salt.

Oxidant and reductant are typically added to the reaction mixture in separate streams or as a single shot, preferably concurrently with the monomer mixture. The reaction temperature is maintained at a temperature lower than 100° C. throughout the course of the reaction. Preferred is a reaction temperature between 30° C. and 85° C., preferably below 60° C. The monomer mixture may be added neat or as an emulsion in water. The monomer mixture may be added in one or more additions or continuously, linearly or not, over the reaction period, or combinations thereof. The type and amount of redox initiator systems may be the same or different in the various stages of the emulsion polymerization.

Optionally, a chain transfer agent and an additional emulsifier can be used. Representative chain transfer agents are carbon tetrachloride, bromoform, bromotrichloromethane, long chain alkyl mercaptans and thioesters such as n-dodecyl mercaptan, t-dodecyl mercaptan, octyl mercaptan, tetradecyl mercaptan, hexadecyl mercaptan, butyl thioglycolate, isooctyl thioglycolate, and dodecyl thioglycolate. The chain transfer agents are used in amounts up to about 10 parts per 100 parts of polymerizable monomers.

Often at least one anionic emulsifier is included in the polymerization charge and one or more of the known nonionic emulsifiers may also be present. Examples of anionic emulsifiers are the alkali metal alkyl aryl sulfonates, the alkali metal alkyl sulfates and the sulfonated alkyl esters. Specific examples of these well-known emulsifiers are sodium dodecylbenzenesulfonate, sodium disecondary-butylnaphthalene sulfonate, sodium lauryl sulfate, disodium dodecyldiphenyl ether disulfonate, disodium n-octadecylsulfosuccinamate and sodium dioctylsulfosuccinate.

Optionally, other ingredients well known in the emulsion polymerization art may be included such as chelating agents, buffering agents, inorganic salts and pH adjusting agents.

Polymerization at an acid pH lower than about 5.0 permits direct preparation of an aqueous colloidal dispersion with relatively high solids content without problems of undue viscosity and coagulant formation. The polymerization is carried out batch-wise, stepwise or continuously with batch and/or continuous addition of the monomers in a conventional manner.

The required monomers can be co-polymerized in such proportions, and the resulting emulsion polymers can be physically blended, to give products with the desired balance of properties for specific applications. Thus, by varying the monomers and their proportions, emulsion polymers having optimum properties for particular triggered response applications can be designed.

In practice it is normally desirable to co-polymerize about 15-60 weight percent based on total monomers, preferably about 20-40 weight percent of one or more acidic monomers, about 15-80 weight percent, preferably about 40-70 weight percent, of one or more non-ionic vinyl monomers and about 1-30 weight percent, preferably about 2-20 weight percent, of one or more non-ionic vinyl surfactant ester monomers. Particularly effective liquid emulsion polymer electrolytes are obtained by copolymerization of a total of about 20-50 weight percent of acrylic acid and methacrylic acid, about 40-70 weight percent of ethyl acrylate, and about 2-12 weight percent of the methacrylic ester of a $C_{12}$-$C_{24}$ alkoxypoly(ethyleneoxy) ethyl alcohol.

ASE and HASE Polymer Properties

In general, the ASE and HASE copolymer dispersions obtained have a solids content ranging from 20 to 50% by weight and the copolymer has a weight average molecular weight of about 200,000 to 10,000,000, when no polyethylenically unsaturated monomer is incorporated into the polymer, as determined by gel permeation chromatography (GPC). A chain transfer agent may be used to obtain weight average molecular weights down to 30,000 or lower.

The ASE and HASE copolymer products prepared by emulsion polymerization at an acid pH are in the form of stable aqueous colloidal dispersions usually with a typical milky latex appearance. Such a liquid emulsion contains the copolymer dispersed as discrete particles having average particle diameters of about 500-3000 Å, as measured by light scattering.

In the form of a stable, aqueous colloidal dispersion at an acid pH of about 2.5-5.0 the ASE and HASE copolymers are particularly useful and have desirable film forming properties. Such aqueous dispersion may contain about 10-50 weight percent of polymer solids yet be of relatively low viscosity. Thus it is readily metered and blended with aqueous product systems. However, the dispersion is ionic strength responsive. When the ionic strength of the polymer dispersion is adjusted by addition of a base such as ammonia, an amine or a non-volatile inorganic base such as sodium hydroxide, potassium carbonate or the like, the aqueous mixture becomes translucent or transparent as the polymer dissolves at least partially in the aqueous phase with a concurrent increase in viscosity. This neutralization can occur in-situ when the liquid emulsion polymer is blended with an aqueous solution containing a suitable base. Or if desired for a given application, pH adjustment by partial or complete neutralization can be carried out before or after blending the liquid emulsion polymer with an aqueous product.

The glass transition temperature ("Tg") of the ASE and HASE polymers typically range from −60° C. to 150° C., preferably from −20 C to 50° C., the monomers and amounts of the monomers selected to achieve the desired polymer Tg range are well known in the art. Tgs used herein are those calculated by using the Fox equation (T. G. Fox, Bull. Am. Physics Soc., Volume 1, Issue No. 3, page 123(1956)). that is, for calculating the Tg of a copolymer of monomers M1 and M2, $$1/Tg(\text{calc.})=w(M1)/Tg(M1)+w(M2)/Tg(M2),$$

wherein

Tg(calc.) is the glass transition temperature calculated for the copolymer w(M1) is the weight fraction of monomer M1 in the copolymer w(M2) is the weight fraction of monomer M2 in the copolymer Tg(M1) is the glass transition temperature of the homopolymer of M1

Tg(M2) is the glass transition temperature of the homopolymer of M2,

All temperatures being in ° K. The glass transition temperatures of homopolymers may be found, for example, in "Polymer Handbook", edited by J. Brandrup and E. H. Immergut, Interscience Publishers.

The term "liquid emulsion polymer" as applied to the ASE and HASE polymers means the polymer was prepared by emulsion polymerization even though the polymer per se may be (and generally is) a solid at room temperature but is a "liquid" emulsion polymer because it is in the form of a liquid dispersion.

The ASE and HASE polymers of this invention are advantageous for use as barrier compositions that surround, encapsulate and/or form a matrix with one or more active ingredients/beneficial agents. Two or more ASE and/or HASE polymers may be used, if desired. Of course the HASE polymers are preferably film-forming at temperatures below about 25° C., either inherently or through the use of plasticizers. It has been discovered that both ASE and HASE polymers form effective barrier materials for surrounding, encapsulating and/or forming a matrix with one or more active ingredients immersed in an aqueous system, such that the stability of the barrier materials changes by altering the ionic strength; and in addition to ionic strength by altering: pH, surfactant concentration, temperature, mechanical forces and the combinations thereof the aqueous system. In an aqueous system under certain ionic strength conditions the materials are stable, forming effective barriers to contain or encapsulate one or more actives. Exposing the materials to a subsequent aqueous system whose ionic strength has been changed, depending on the type of triggered response composition(s) employed, triggers instability in the materials such that the active ingredients are rapidly dispersed in the aqueous system.

Barrier compositions prepared from one or more ASE and/or HASE polymers form impermeable membranes that surround, encapsulate and/or form a matrix with one or more active ingredients, providing sufficient structural support while inhibiting the release of the beneficial agent prior to the ionic strength triggered dissolution of the barrier of the device. Aqueous system refers to any fluid or solution containing water as the principal liquid component (e.g. solutions of organic or inorganic substances particularly electrolytes, mixtures of substance in water and physiological fluids). Typically the barrier composition totally surrounds, encapsulates and/or forms a matrix with the beneficial agent/active ingredient. One or more additives may be combined with the ASE and HASE polymers to prepare a composite barrier to totally surround, encapsulate and/or form a matrix with the beneficial agent if desired. The barrier and composite barrier materials have a combination of thickness and mechanical strength so that they are disrupted by the triggered response of the ASE and HASE polymers (triggered response compositions) thus releasing the beneficial agent. Preferably the barriers are 0.1 μm to 1 mm in thickness. Preferably the barriers are 10 μm to 300 μm in thickness for personal care and cleaning applications. The barrier may be a coating, a thin film, a dense film, a composite barrier, a container, a capsule and/or matrix beads.

Typically, a barrier composite is composed of the triggered response polymers and copolymers, polymer blends, biopolymers, and any other naturally occurring and synthetic material, although appropriately treated inorganic materials such as ceramics, metals or glasses may be used. The following is a preferred listing of components and additives that can be incorporated into the barrier material and device of the present invention.

Cellulose esters such as cellulose acetate, cellulose acetate acetoacetate, cellulose acetate benzoate, cellulose acetate butylsulfonate, cellulose acetate butyrate, cellulose acetate butyrate sulfate, cellulose acetate butyrate valerate, cellulose acetate caprate, cellulose acetate caproate, cellulose acetate caprylate, cellulose acetate carboxymethoxypropionate, cellulose acetate chloroacetate, cellulose acetate dimethaminoacetate, cellulose acetate dimethylaminoacetate, cellulose acetate dimethylsulfamate, cellulose acetate dipalmitate, cellulose acetate dipropylsulfamate, cellulose acetate ethoxyacetate, cellulose acetate ethyl carbamate, cellulose acetate ethyl carbonate, cellulose acetate ethyl oxalate, cellulose acetate furoate, cellulose acetate heptanoate, cellulose acetate heptylate, cellulose acetate isobutyrate, cellulose acetate laurate, cellulose acetate methacrylate, cellulose acetate methoxyacetate, cellulose acetate methylcarbamate, cellulose acetate methylsulfonate, cellulose acetate myristate, cellulose acetate octanoate, cellulose acetate palmitate, cellulose acetate phthalate, cellulose acetate propionate, cellulose acetate propionate sulfate, cellulose acetate propionate valerate, cellulose acetate p-toluene sulfonate, cellulose acetate succinate, cellulose acetate sulfate, cellulose acetate trimellitate, cellulose acetate tripropionate, cellulose acetate valerate, cellulose benzoate, cellulose butyrate napthylate, cellulose butyrate, cellulose chlorobenzoate, cellulose cyanoacetates, cellulose dicaprylate, cellulose dioctanoate, cellulose dipentanate, cellulose dipentanlate, cellulose formate, cellulose methacrylates, cellulose methoxybenzoate, cellulose nitrate, cellulose nitrobenzoate, cellulose phosphate (sodium salt), cellulose phosphinates, cellulose phosphites, cellulose phosphonates, cellulose propionate, cellulose propionate crotonate, cellulose propionate isobutyrate, cellulose propionate succinate, cellulose stearate, cellulose sulfate (sodium salt), cellulose triacetate, cellulose tricaprylate, cellulose triformate, cellulose triheptanoate, cellulose triheptylate, cellulose trilaurate, cellulose trimyristate, cellulose trinitrate, cellulose trioctanoate, cellulose tripalmitate, cellulose tripropionate, cellulose trisuccinate, cellulose trivalerate, cellulose valerate palmitate and combinations thereof. Cellulose ethers such as 2-hydroxybutyl methyl cellulose, 2-hydroxyethyl cellulose, 2-hydroxyethyl ethyl cellulose, 2-hydroxyethyl methyl cellulose, 2-hydroxypropyl cellulose, 2-hydroxypropyl methyl cellulose, dimethoxyethyl cellulose acetate, ethyl 2-hydroxylethyl cellulose, ethyl cellulose, ethyl cellulose sulfate, ethylcellulose dimethylsulfamate, methyl cellulose, methyl cellulose acetate, methylcyanoethyl cellulose, sodium carboxymethyl 2-hydroxyethyl cellulose, sodium carboxymethyl cellulose. Polycarbonates. Polyurethanes. Polyvinyl acetates. Polyvinyl alcohols. Polyesters. Polysiloxanes such as poly(dimethylsiloxane) and Polyaminoacids such as polyaspartic acid. Polyacrylic acid derivatives such as polyacrylates, polymethyl methacrylate, poly(acrylic acid) higher alkyl esters, poly(ethylmethacrylate), poly(hexadecyl methacrylate-co-methylmethacrylate), poly(methylacrylate-co-styrene), poly(n-butyl methacrylate), poly(n-butyl-acrylate), poly(cyclododecyl acrylate), poly(benzyl acrylate), poly(butylacrylate), poly(secbutylacrylate), poly(hexyl acrylate), poly(octyl acrylate), poly(decyl acrylate), poly(dodecyl acrylate), poly(2-methyl butyl acrylate), poly(adamantyl methacrylate), poly(benzyl methacrylate), poly(butyl methacrylate), poly(2-ethylhexyl methacrylate), poly(octyl methacrylate), acrylic resins. Polyethers such as poly(octyloxyethylene), poly(oxyphenylethylene), poly(oxypropylene), poly(pentyloxyethylene), poly(phenoxy styrene), poly (secbutroxylethylene), poly(tert-butoxyethylene), copolymers thereof and polymer blends thereof.

Typical naturally occurring materials include: insect and animal waxes such as chinese insect wax, beeswax, spermaceti, fats and wool wax; vegetable waxes such as bamboo leaf wax, candelilla wax, carnauba wax, Japan wax, ouricury wax, Jojoba wax, bayberry wax, Douglas-Fir wax, cotton wax, cranberry wax, cape berry wax, rice-bran wax, castor wax, indian corn wax, hydrogenated vegetable oils (e.g., castor, palm, cottonseed, soybean), sorghum grain wax, Spanish moss wax, sugarcane wax, caranda wax, bleached wax, Esparto wax, flax wax, Madagascar wax, orange peel wax, shellac wax, sisal hemp wax and rice wax; mineral waxes such as Montan wax, peat waxes, petroleum wax, petroleum ceresin, ozokerite wax, microcrystalline wax and paraffins; and synthetic waxes such as polyethylene wax, Fischer-Tropsch wax, chemically modified hydrocarbon waxes including poly(ethyleneglycolated) waxes and cetyl esters wax.

In a preferred embodiment, the ionic strength trigger is an ionic strength sensitive barrier composition surrounding the ingredients, the barrier substantially impermeable to releasing the active ingredients to the aqueous system and remaining insoluble in the aqueous system at relatively high ionic strength (for example, equivalent to 0.01 M sodium carbonate or greater), the barrier becoming soluble in an aqueous system at relatively lower ionic strength (for example, equivalent to less than 0.001 M sodium carbonate) and effecting the rapid release of the active ingredients.

The triggered response composition in the barrier material or the device is usefully employed in the invention in form of, for example, a film, a coating, a tablet, a container, a packet, capsule, pellet, sachet, matrix beads, and encapsulated polymer granules. The ionic strength responsive trigger means is provided in a capsule or tablet by for example bonding, encasing, friction fitting, partially encasing the barrier material, for example, either as an adhesive, joining portions of the barrier, as an outer coating, or forming encapsulated particles and co-granulated particles together to form the capsule or tablet. The ionic strength responsive trigger means in the aqueous system causes bursting of the device followed by release of one or more beneficial agents/active ingredients.

Optionally, the ionic strength responsive barrier materials are trigger response polymer blends or they are blended with an inert non-dissolving material. By inert is meant a material that is not substantially affected by a change in ionic strength and/or other parameters in the triggering range. By altering the proportion of a ionic strength responsive material to one or more inert non-dissolving materials, the time lag subsequent to triggering and prior to release may be controlled. The inert non-dissolving material is added to further provide mechanical strength and stability to the barrier material or device during use (for example, after the polymer and barrier swells) or storage. Typical inert non-dissolving material usefully employed in the invention is listed the materials described as additives to the barrier material or device. Preferably, the inert material is selected from the list of additives given above.

The term beneficial agent refers to substances for which it is desirable and/or advantageous to triggered delivery into an environment of use. Beneficial agents include those agents in the form of a gas, solid or liquid state.

The term beneficial agent refers to substances for which it is desirable and/or advantageous to control delivery into an environment of use. Examples of such substances include: detergent additives and cleaning additives including, for example, fabric softeners, fabric softener formulations, cationic, anionic, amphoteric and non-ionic surfactants, scale controllers, anti-foam agents, buffers, amphoteric additives, builders, bleaches, organic additives, inorganic additives, whiteners, dyestuffs, stain removers, water hardness agents, reductants, oxidants, optical brighteners, UV protective agents, wrinkle reducing agents, gray-inhibitors, soil repellants, oil-absorbing polymers, waterproofing polymers, active-retaining polymers, redeposition agents, anti-redeposition agents, polymers which inhibit the formation of soil and oily materials, detergent additive formulations, biocidal compositions and formulations, antimicrobial compositions and formulations, pharmaceutical compositions and formulations, activating agents, stabilizing agents, polymers with special detergent properties such as co-builders and anti-redeposition agents, pH controlling agents, enzymes, enzyme inhibitors, disinfectants, personal care agents, water softening agents, absorbants, flavors and fragrances. Typical examples of each are described in International publication No. WO 00/17311, U.S. Patent Application Publication No. 2001/0031714 A1 and U.S. Pat. No. 5,358,502.

Although any mixture of the above ingredients may be used that satisfactorily delivers the beneficial agent, typically the ionic strength-trigger means is 0.01% to 50% by weight of the device and the barrier including ionic strength-trigger means is typically 1% to 30% of the device. Preferably the ionic strength-trigger means is 0.1% to 20% of the device and the membrane, including ionic strength-trigger means, is 1% to 20% of the device. The amount of beneficial agent is the amount that is sufficient to achieve the desired effect (e.g., cleaning effect, softening effect personal care effect, and combinations thereof). The remainder weight can be made up of any desired formulation ingredients (described above) and other additives.

The devices of the invention preferably contain a solid beneficial core or a liquid beneficial core. Optionally, the devices of this invention can also be administered within a capsule comprising a water-soluble wall. For example, the devices can be manufactured to be of suitable size for inclusion either singularly or multiply within a gelatin capsule such that when the capsule dissolves the device(s) are released into the environment of use. While the devices to be included within a capsule can be of a variety of shapes, a preferred shape for such devices is spherical or substantially spherical. The exact number and size of such devices can and will be determined according to a variety of well known factors. For example, the environment of use, the beneficial agent or agents, the amount of beneficial agent and the rate of release are all factors to be considered in determining the size, shape, and number of devices to be included in such capsules as well as the composition of the capsule.

The devices of this invention having the above described desired characteristics may be made using the above described materials using the following processes and other conventional methods.

Capsule formulations may be prepared by forming a cap and body of the above-described polymers. In a conventional fashion, the triggered response polymers may be molded into the desired shapes and sintered or dip-coated (in a similar fashion to the way hard gelatin capsules are made). Preferably they are prepared by conventional coating techniques including, for example, spray coating, Wurster coating and pan coating. Alternatively, hard gelatin capsules may be coated with the barrier coating. These capsule bodies and caps are then filled with the beneficial agent in the form of a gas, liquid or solid and other excipients (e.g., osmagent, swellable component) using standard capsule filling techniques. Then the capsule is sealed with the desired ionic strength-responsive material and assembled. This may be performed using conventional capsule-sealing equipment.

Tablets may be prepared using conventional processes and conventional tableting and tablet-coating equipment. The tablet cores can be made by direct compression of the beneficial agent and other desired excipients (e.g., osmagent swellable material) or other common tableting methods. To minimize incompatibilities or provide a suitable substrate for the barrier coating, the tablets may first be coated with a water-soluble pre-coat. The pre-coat may consist of sugars, salts, soluble cellulose derivatives or other water-soluble materials.

The tablet cores are coated with either a dense triggered response barrier material or composite using conventional coating techniques. These films can be applied using conventional equipment such as fluid-bed coaters, pan-coaters, Wurster coaters, spray-dryers or by dip-coating.

In a preferred embodiment, the barrier composition is stable and insoluble in an aqueous system at relatively high ionic strength; wherein the barrier exhibits one or more chemical/physical responses selected from dispersing, disintegrating, dissolving, destabilizing, deforming, swelling, softening, flowing and combinations thereof; wherein the chemical/physical response of the composition is triggered upon one or more ionic strength changes to the aqueous system; wherein the device is capable of releasing the active ingredients to the aqueous system as a result of the triggered response of the barrier composition; wherein the device is prepared using coating technology selected from the group consisting of fluid bed spray coating, Wurster coating, Pan coating and co-extrusion, coacervation, spray drying and spray chilling; and optionally, wherein one or more beneficial liquid ingredients are co-granulated with one or more solid active ingredients in the form of solid granules, pellets, tablets, encapsulated granules, sachets, matrix beads and capsules.

One or more layers or coatings of an ionic strength responsive material is applied over on tablet cores. The coatings may be applied using standard coating methods analogous to those described to apply the barrier coating.

Beads, granules or multiparticulates may be prepared by analogous methods to those used to prepare tablets.

Barrier compositions prepared from one or more ASE and HASE polymers form impermeable barriers that surround, encapsulate and/or form a matrix with one or more active ingredients, providing sufficient structural support while inhibiting the release of the beneficial agent prior to the triggered dissolution or dispersion of the barriers of the device. Aqueous system refers to but is not limited to a solution containing water as the principal liquid component including for example aqueous solutions of organic solvents, inorganic substances particularly electrolytes and surfactant mixtures of substance in water. Typically the barrier composition totally surrounds, encapsulates or forms a matrix with the beneficial agent/active ingredient or forms an impermeable matrix of the barrier composition and the beneficial agent/active ingredient. The impermeable barrier membrane material has a combination of thickness and mechanical strength so that it will be sufficiently stable at predetermined system including but not limited to a heavy duty liquid (HDL) formulation or fabric laundry wash cycle and will rapidly disrupt and release the beneficial ingredients once the desired triggered release environment has been generated. Preferably the impermeable barrier membrane is 5 μm to 300 μm in thickness for household and personal care applications, such as fabric care laundry application. The impermeable barrier membrane may be a dense film, a composite membrane, asymmetric in structure and the like. The preferred particle size of the impermeable matrix beads of the barrier composition and the beneficial agent/active ingredient 20 to 5000 μm. Typically the device of the barrier composition material and the beneficial ingredients is composed of emulsion polymers and personal care and household care actives including but not limited to fabric care actives, personal care actives and fragrance.

The selected group of ASE and HASE polymers in any structural form may be used as the ionic strength trigger means; or in addition to an ionic strength trigger means, a pH, surfactant concentration level, temperature, mechanical agitation and combinations thereof, trigger means that maintains the integrity of the device until triggered by a solution of the desired trigger conditions. The trigger device may be for example an impermeable dense coating membrane or an impermeable matrix. Preferably, the trigger device provides sufficient structural support and is, preferably, impermeable to water which inhibits the core from contacting with the aqueous system, and releasing the beneficial agent until triggered. Typically the trigger device is selected from a group of ASE and HASE barrier compositions surrounding, encapsulating and/or forming a matrix with the ingredients, the barrier substantially impermeable to releasing the active ingredients to the aqueous system and remaining insoluble in the aqueous system at a predetermined conditions, the barrier becoming solubilized, swelled, dispersed, deformed and/or disintegrated in an aqueous system when the ionic strength changes; and in addition to ionic strength changes, changes in pH, temperature, surfactant concentration levels, mechanical forces and combinations thereof, effecting the rapid release of the active ingredients.

Typically the barrier materials are insoluble solids in an aqueous system including but not limited to fabric laundry wash cycle, and then they dissolve (or degrade and dissolve) when the ionic strength changes; and in addition to ionic strength changes, changes in pH, temperature, surfactant concentration levels, mechanical forces and the combinations of thereof, in the system.

The devices of this invention having the above described desired characteristics may be made using the above described materials using the following processes and other conventional techniques and methods. Conventional techniques for preparing delivery devices include, for example, those disclosed in U.S. Pat. No. 5,358,502.

In one preferred embodiment of the present invention, one or more beneficial ingredients are encapsulated with impermeable membranes of one or more barrier compositions via conventional coating technology, including but not limited to fluid bed spray coating, Wurster coating, Pan coating, etc. The beneficial ingredients in liquid states can be co-granulated with other solid form active ingredients to form solid granules or tablets prior to coating process or it can be incorporated along or else together with other active ingredients into a capsule made from a water soluble polymer such as, for example, gelatin. A filled gelatin capsule of this kind of beneficial ingredients is then provided with the coating comprising of barrier compositions. The coating may be made sufficiently thick so that it will be sufficiently stable in wash cycle and rapidly dispersed to release beneficial ingredients in rinse cycle.

In order to ensure that the coating of the barrier compositions does not dissolve in the earlier steps of the washing or cleaning operation, for example, at the beginning of the main wash cycle in the case of machine laundry washing, the stability of the barrier compositions membrane can be controlled by adjusting the degree of neutralization of the barrier compositions so that it will be insoluble at the early beginning of the wash cycle when detergent has not dissolved, then upon neutralization by the aqueous system after the dissolution of detergent, the barrier membrane will remain stable in wash cycle and rapidly dissolved or dispersed in rinse cycle.

In another preferred embodiment of the present invention, one or more beneficial ingredients are encapsulated with impermeable membranes of one or more barrier compositions or an impermeable matrix of one or more beneficial ingredients and one or more barrier compositions via emulsion polymerization, suspension polymerization, and microsuspension polymerization. Depending on which polymerization process is employed, the particle size of the final encapsulated particles or matrix particles is between 0.01 to 1000 μm.

In another preferred embodiment of the present invention, one or more beneficial ingredients are encapsulated with one or more barrier compositions to form polymeric matrix beads. The matrix beads have the same actives in the cores as are described above and surrounded by a solid polymer protective shell formed during the solidification process by either spray drying or spray chilling or by precipitating with inorganic salt solution such as $CaCl_2$ or $Na_2SO_4$. Likewise the beads are preferably about 10 to 5000 μm big. The matrix beads made of polymer barrier compositions and beneficial ingredients contain 5 to 80% polymer barrier composition, 5 to 75% beneficial ingredients and 0 to 10% aids including surfactants. Preferably, the matrix beads should contain 5 to 50% ASE barrier polymers, 20 to 75% beneficial ingredients and 0 to 10% aids including surfactants.

The device shape and dimensions can vary based on the particular application (e.g., tablets, beads or capsules). The shape and size may also vary depending on the application so that for example the tablet is suitable depending on the quantity and rate of beneficial agent releasing which vary based on the application. Preferably, the tablet is 0.5 to 20 mm in diameter and the beads are 5 μm to 5 mm in diameter. However, typical device dimensions range from about 1 cm to about 2.5 cm in length and about 0.3 cm to about 1 cm in diameter for personal care and household applications. For other applications, such as flavors, fragrances, and other active ingredients for household and personal care applications, shapes and sizes will be determined by the method of use and may be different from those listed above.

It should be understood that the invention is not limited to the particular embodiments shown and described herein, but that various changes and modifications may be made without departing from the spirit and scope hereof as defined by the following claims. The invention is further disclosed and illustrated in the following examples.

EXAMPLE 1

Triggered Response of Thin Films from HASE Polymers

Thin films cast on glass slides preparations: Polymer thin films with a thickness of about 20 μm were prepared by first pre-neutralizing a HASE polymer emulsion to a desired pH with an aqueous solution of 0.1 M NaOH, then casting the emulsion onto a glass slide, and drying on a hot plate at 60 to 70° C. for 20 to 30 minutes.

Free standing films preparation: Free standing polymer films were prepared by casting 1 gram of a pre-neutralized emulsion onto an aluminum weighing pan and drying at 70° C. in a ventilated oven for 120 minutes. After the film was dry, the free standing film with thickness of 100 to 200 μm was peeled off from the aluminum weighing pan.

Beaker test for evaluating triggered response films: Thin films cast on glass slides were immersed in an 0.6% solution of Tide® detergent solution to test washing condition stability. Rinse solubility tests were performed by placing the thin films in rinse water prepared using tap water (water hardness 90 ppm) and adjusting the solution to pH 8.5 (adjusted with NaOH solution). No mechanical agitation was applied to the test solutions.

Terg-O-Tometer® test: Free standing films were tested in a Terg-O-Tometer.

Test Conditions are the Following:

A: Wash Conditions:

Detergent concentration: 0.6% Tide powder detergent;

Temperature: 25° C.;

Agitation: 90 RPM;

Hardness of the wash water: 300 ppm.

Fabric added: 5 gram black cotton cloth.

Washing time: 15 minutes

A HASE polymer film (0.2 gram) was dosed in a 1-liter Terg pot and washed at 25° C. After a washing cycle, the wash water was filtered using a screen with pore size smaller than 100 mesh.

B: Rinse Conditions:

Temperature: Room temperature;
Agitation: 90 RPM;
Fabric added: 5 gram;
Time: 5 minutes.

The response results of films with different compositions are summarized in Table 1.

TABLE 1

Polymer compositions suitable for laundry applications

| Samples | Polymer composition pH | Stability in washing conditions: Beaker Test | Stability in washing conditions: Terg Test | Solubility in rinse conditions: Beaker Test | Solubility in rinse conditions: Terg Test |
|---|---|---|---|---|---|
| Composition A 10 Sipomer BEM(ai)/60 MA/20 AA/10 MAA | 4.92 | stable | partially dissolved | partially dissolved | partially dissolved |
| Composition B 10 VSM 1/60 MA/20 AA/10 MAA | 5.04 | stable | partially dissolved | dissolved | dissolved |
| Composition C 10 VSM-1/60 EA/20 AA/10 MAA | 5.2 | stable | stable | dissolved | dissolved |
| Composition D 10 VSM-1/60 EA/20 AA/10 MAA//0.2 DAP | 5.2 | very stable | stable | dissolved | dissolved |
| Composition B 10 VSM-1/70 EA/20 AA | 5.5 | stable | stable | Did not dissolve | partially dissolved |

Sipomer BEM is supplied by Rhodia and its active ingredient is behenyl $(EO)_{25}$ methacrylate. VSM-1 is a Rohm and Haas surfactant monomer, Cetyl-stearyl $(EO)_{20}$ methacrylate. MA is methyl acrylate, AA is acrylic acid, MAA is methacrylic acid, EA is ethyl acrylate, and DAP is diallyl phthalate. The term "dissolved" indicates no polymer particles larger than 100 mesh (@ 150 um) were collected after a washing cycle.

By changing the monomer selections, polymer charge density and degree of neutralization, the properties of polymer films can be tuned to be sufficiently stable in a fabric laundry wash cycle and are subsequently triggered to dissolve or disperse under fabric laundry rinse cycle conditions.

EXAMPLE 2

Triggered Response Thin Films Cast on Glass Slides

Samples were prepared as described in EXAMPLE 1. Beaker evaluation tests were performed under the conditions described in EXAMPLE 1.

TABLE 2

Triggered response thin film compositions

| Samples | Compositions | pH | Stability in 0.6% powder detergent solution | Solubility in pH 8.5 tap water |
|---|---|---|---|---|
| Sample 1 | 35 EA/65 MAA// 0.033 BGDMA | 5.0 | Film started to swell and became slimy within 5 min. | Dissolved within 5 min. |
| Sample 2 | 60 EA/40 MAA// 0.2 DAP | 6.0 | Film started to swell and became slimy within 10 min. | Film deformed in 5 min., did not dissolve. |

BGDMA is butylene glycol dimethacrylate.

EXAMPLE 3

Triggered Response of Free Standing Films and Particles Made from Compositions D, Compositions F to H Sample Preparation:

a: Free standing films:

samples were prepared as described in EXAMPLE 1 b: Coagulated polymer particles.

A composition D emulsion was first neutralized to pH 5.2 with an aqueous solution of 0.1 M NaOH, then coagulated with 10% $CaCl_2$ aqueous solution at room temperature. The precipitate was filtered and dried at room temperature. Solid particles were further broken down with Waring Blender and sieved to obtain a particle size between 420 to 1000 μm.

Free standing films and particles were tested in a Terg-O-Tometer® under the conditions described in EXAMPLE 1. Tables 3 and 4 summarize the triggered responses of coagulated polymer particles and free standing films tested at 40° C. and 60° C. in a Terg-O-Tometer®.

TABLE 3

High temperature performance of coagulated polymer particles under fabric laundry conditions (Polymer Composition D).

| Sample | Temperature (° C.) | Wash Time (min.) | Time dissolved at rinse (min.) | Particle size (μm) |
|---|---|---|---|---|
| Test 1 | 60 | 30 | 5 | 1000-840 |
| Test 2 | 60 | 20 | 10 | 1000-840 |
| Test 3 | 40 | 30 | 5 | 840-590 |
| Test 4 | 40 | 20 | 5 | 590-420 |

TABLE 4

High temperature performance of polymer free standing films at fabric laundry conditions.

| Sample | Temperature (° C.) | Wash Time (min.) | Time dissolved at rinse (min.) |
|---|---|---|---|
| Test 5 | 60 | 15 | 5 |
| Test 6 | 60 | 15 | 5 |
| Test 7 | 40 | 30 | 10 |
| Test 8 | 40 | 30 (dissolved) | |
| Test 9 | 40 | 30 (dissolved) | |
| Test 10 | 40 | 30 (dissolved) | |

Note: Test 5-7, Composition D
Test 8 compositions F: 10 VSM-1/60 EA/20 AA/10 MAA//0.15 DAP;
Test 9 compositions G: 10 VSM-1/60 EA/20 AA/10 MAA//0.25 DAP;
Test 10 compositions H: 10 VSM-1/60 EA/20 AA/10 MAA//0.30 DAP.

EXAMPLE 4

Triggered Response of Free Standing Films of Composition D with Different Degrees of Neutralization Compositions D emulsions were pre-neutralized with an aqueous solution of 0.2 M NaOH to different degrees of neutralization, the triggered response of their corresponding free standing films were tested in the Terg-O-Tometer® at 40° C. for 20 minutes for wash cycle and at room temperature 5 minutes for rinse cycle under the conditions described in EXAMPLE 1. Table 5 summarized the results:

TABLE 5

Triggered response of Compositions D under different degrees of neutralization

| Degree of neutralization (%) | pH of emulsion | Film thickness (μm) | Stability in wash | Solubility in rinse |
|---|---|---|---|---|
| 0 | 2.3 | 100 | Partially dissolved | Dissolved in 5 min. |
| 2.5 | 3.8 | 50 | Partially dissolved | Dissolved in 5 min. |
| 5 | 4.5 | 50 | Did not dissolve | Dissolved in 5 min. |
| 7.5 | 4.8 | 50 | Did not dissolve | Dissolved in 5 min. |
| 15 | 5.2 | 70 to 90 | Did not dissolve | Dissolved in 5 min. |

The triggered response of the barriers can be affected by both the degree of neutralization of the polyelectrolytes and film forming properties of the polyelectrolyte used to prepare the barriers. When the degree of neutralization of polymer composition D is equal to or large than 5%, the corresponding emulsions possess better film forming properties. Therefore, the resulting barriers exhibited better stability in the system tested above.

EXAMPLE 5

Formation of Triggered Responsive HASE Emulsion Polymer Coated Sugar Tablets by a Pan Coating Process and the Triggered Response Results of the Coated Sugar Tablets Core material: Sugar tablets with a composition of 88% lactose, 10% (micro-crystalline cellulose) MCC and 2% of disintegrating agents were used as core materials. Disintegration time of the sugar tablets is 1 to 2 minutes.

A HASE emulsion polymer (composition D) was used for a coating material. The emulsion was pre-neutralized to pH=5.2 with 0.2 M NaOH solution. Final solids content is 17% by weight.

A 15 inch pan coating unit manufactured by Thomas Engineering Inc. was used. Processing parameters are summarized in Table 6.

TABLE 6

Coating Conditions

| Sample | Flow rate (g/min) | Atomizing Pres. (psi) | RPM | Inlet air Pres. (psi) | Inlet Temp. (° C.) | Bed Temp. (° C.) | Polymer Loading (wt. %) |
|---|---|---|---|---|---|---|---|
| D | 18-20 | 50 | 14-20 | 270 | 72 | 55 | 15 |
| D | 17-19 | 50 | 15-21 | 270 | 70-72 | 55 | 13 |

Evaluation Results:

The barrier properties of polymer coatings on sugar tablets in detergent solutions were evaluated. Coated sugar tablets were placed in an aqueous detergent solution prepared from 0.6 wt. % Tide® (powder) without agitation, and the disintegration times of coated sugar tables with different coating levels at ambient temperature are summarized in Table 7.

TABLE 7

Disintegration Times of HASE Polymer Coated Sugar Tablets

| Coating level (wt. %) | 3 | 5 | 7 | 9 | 11 | 13 |
|---|---|---|---|---|---|---|
| Disintegration time in 0.6% detergent solution (min.) | 10 | 10-15 | 30 | 60 | 1440 | 4320 |

Sugar tablets with 13 wt % coating level were also tested at 60° C. without agitation in 0.6% Tide® detergent solution. Tablets remained stable in the detergent solutions for more than 40 minutes.

Sugar tablets with 13 wt % coating level disintegrated in 10 to 15 minutes in tap water at ambient temperature.

The triggered responsive barrier membranes coating formed in the manner described above were dense films about 100 μm thick. They were sufficiently stable in an aqueous system in a fabric laundry wash cycle and dispersed rapidly when the trigger was introduced in a fabric laundry rinse cycle. When the ionic strength responsive barrier membrane was triggered by the ionic strength change from the wash cycle to the rinse cycle, the tablet coating burst and released the tablet contents.

EXAMPLE 6

Formation of Triggered Responsive Barrier Polymer and Beneficial Ingredient Matrix Beads Experimental: A polymer emulsion (composition D) was first neutralized to pH 5.4 using an aqueous solution of 0.1 M NaOH. The partially neutralized emulsion was mixed with non-ionic surfactant and ester quats (fabric softening agent) to form a homogenous system under mechanical agitation (magnetic stirring). Aliquots of this mixture were added to a 10% solution of calcium chloride at 60° C. to produce the cross-linked polymer beads. By modifying the drop size and the rate of addition, sizes of the beads can be changed to any useful size desired. A final formulation of the polymeric matrix beads is:

5 g emulsion composition D (solids content: 10%)
0.5 g Fabric softener (ester quats content: 28%)
0.05 g non-ionic surfactant A stability test was performed by placing the resulting beads, with particle size of 2 to 3 mm, into a 0.6% detergent solution under mild agitation (magnetic stirring). A solubility test was performed by testing the dissolution time of the beads which were first immersed in the 0.6% detergent solution at room temperature for 20 minutes. No change in or deformation of the beads was observed. The beads were then transferred to tap water (water Hardness 90 ppm) adjusted to pH 8.5 at room temperature under mild agitation (magnetic stirring). The beads exhibited different levels of disintegration, deformation, swelling, dissolution and/or dispersion, depending on the period of time they remained immersed in the tap water solution.

TABLE 8

Evaluation results of polymeric matrix beads with beneficial ingredients

| Time (min) | Stability in 0.6% detergent solution at room temperature | Stability in tap water, pH 8.5 at room temperature |
|---|---|---|
| 10 | No change | — |
| 20 | No change | 50% of beads disintegrated |
| 30 | No change | Approx. 90% of beads disintegrated |
| 50 | No change | Beads completely dispersed/disintegrated |

We claim:

1. A triggered response barrier composition comprising: one or more polyelectrolytes in contact with an aqueous system at an ionic strength equivalent to 0.01 M sodium carbonate or greater, wherein the polyelectrolyte is stable and insoluble in the aqueous system, wherein the barrier composition surrounds, encapsulates, and/or forms a matrix with one or more active ingredients and is substantially impermeable to releasing the active ingredients to the aqueous system, and the barrier composition has the property that, when in contact with an aqueous system at an ionic strength equivalent to less than 0.001 M sodium carbonate, the barrier composition responds by releasing said active ingredient to said aqueous system by exhibiting one or more responses selected from dispersing, disintegrating, dissolving, destabilizing, swelling, deforming, softening, flowing, and combinations thereof: wherein the polyelectrolyte is one or more alkali soluble or swellable emulsion polymers comprising: (a) 15-70 weight percent of one or more acidic monomers; (b) 15-80 weight percent of one or more non-ionic vinyl monomers; (c) 2-30 weight percent of one or more non-ionic vinyl surfactant monomers, and (d) 0.01 to 5 weight percent of one or more polyethylenically unsaturated monomers, wherein said barrier composition is in the form of tablets, beads, or capsules, and wherein said active ingredients comprise at least one ester quat.

* * * * *